United States Patent [19]

Elmer

[11] 4,157,801

[45] Jun. 12, 1979

[54] DEVICE FOR SUPPORTING A LIMP CONTAINER

[75] Inventor: Frederick L. Elmer, Anaheim, Calif.

[73] Assignee: Pacific Handy Cutter Inc., Costa Mesa, Calif.

[21] Appl. No.: 833,964

[22] Filed: Sep. 16, 1977

Related U.S. Application Data

[63] Continuation-in-part of Ser. No. 779,087, Mar. 18, 1977, abandoned.

[51] Int. Cl.[2] ..... B65B 67/12

[52] U.S. Cl. ..... 248/97; 248/101; 248/150; 403/174; 403/295

[58] Field of Search ..... 248/99, 97, 101, 150, 248/151, 165, 188; 403/295, 174, 178

[56] References Cited

U.S. PATENT DOCUMENTS

| | | | |
|---|---|---|---|
| 575,902 | 1/1897 | Nicholas | 248/97 |
| 711,410 | 10/1902 | Means | 248/100 X |
| 765,388 | 7/1904 | Lanpher | 248/97 |
| 942,231 | 12/1909 | Woodman | 248/100 X |
| 1,052,379 | 2/1913 | Ranken et al. | 248/97 X |
| 1,665,724 | 4/1928 | Way | 248/101 |
| 3,010,689 | 11/1961 | More | 248/150 |
| 3,095,172 | 6/1963 | Dwyer | 248/97 |
| 3,502,291 | 3/1970 | Ackerman et al. | 248/97 |
| 3,604,677 | 9/1971 | Gits | 248/97 |
| 3,614,041 | 10/1971 | Koger | 248/97 |
| 3,627,242 | 12/1971 | Vandermast | 248/97 |
| 3,768,763 | 10/1973 | Hembree | 248/97 |
| 3,771,752 | 11/1973 | Meeh | 248/99 X |
| 3,838,839 | 10/1974 | Spencer | 248/99 |
| 3,866,872 | 2/1975 | Burgess | 248/97 |
| 3,893,649 | 7/1975 | Cornell | 248/99 |
| 3,916,962 | 11/1975 | Stolt | 248/101 X |
| 4,049,355 | 9/1977 | Kawazu | 403/295 X |

*Primary Examiner*—Rodney H. Bonck

*Attorney, Agent, or Firm*—Poms, Smith, Lande, Glenny & Rose

[57] ABSTRACT

A device for supporting a limp disposable container in a generally open position to receive material and for preventing the container from collapsing as material is inserted therein has rim means for releasably engaging portions of the container peripherally about an opening in the container and for supporting these portions in an open position, second means defining a base for providing stability for the device relative to a surface upon which the device is positioned, strut means interconnecting the rim means and the second means for maintaining a desired spaced relationship therebetween and mounting means for securing the rim means and the second means to the strut means to provide a rigid support device for the limp container. The device may be provided in unassembled kit form of primarily straight tube sections suitable for assembly in an easy and facile manner. In an exemplary embodiment, the base rim, top rim and struts each comprise three tubular members, all of which are press-fit together through the use of six interconnecting tees.

1 Claim, 11 Drawing Figures

DEVICE FOR SUPPORTING A LIMP CONTAINER

RELATED APPLICATION

This application is a continuation-in-part of my copending application Ser. No. 779,087 filed Mar. 18, 1977, now abandoned in favor of this application.

BACKGROUND OF THE INVENTION

In recent years the use of light-weight, disposable, thin-walled plastic bags of polyethylene and other materials has become widespread. Although these containers are highly impervious to most materials, cheap and relatively durable, the limp non-rigid nature of the container makes filling an unsupported container rather tedious. The container opening and container side walls tend to collapse as material is inserted into the container unless the container is supported in some manner.

The present invention relates in general to devices for supporting these limp disposable containers in a generally open position to receive material and for preventing the container from collapsing as the material is inserted therein.

Heretofore it has been common for a person using these limp containers, such as trash bags, to hold a portion of the container in one hand while, at the same time, using the other hand to insert material into the container. Another approach has been to place the limp container inside a larger container so that both hands may be used to insert the material into the container.

These prior approaches have been disadvantageous in that the hand-held approach was inefficient and slow while the use of a larger outer container presented handling problems and the problem of storage of the large external container when not in use. Additionally, it has been found to be extremely difficult to remove a filled container, such as a trash bag, from within a closed larger container, such as a trash can, due to the "vacuum effect" produced by the generally intimate contact between the trash bag and the trash can.

SUMMARY OF THE INVENTION

It is therefore a primary object of the present invention to disclose and provide an improved device for supporting a limp disposable container in a generally open position which does not require the use of an operator's hand to prevent the container from collapsing.

It is a further object of the present invention to disclose and provide a device which is light-weight and, at the same time, rigid enough to support a filled container.

It is a further object of the present invention to disclose and provide an improved device which may be conveniently assembled and disassembled for convenient storage during periods of non-use or to be shipped or sold in unassembled kit form.

It is a further object of the present invention to disclose and provide an improved device which may readily be removed from the limp disposable container once the container has been filled and closed.

Generally, stated, the present invention in an improved device for supporting a limp disposable container in a generally open position to receive material and for preventing the container from collapsing as the material is inserted therein includes the provision of a rim member formed of a length of flexible light-weight material having the end portions thereof joined together to form a generally circular hoop. The rim member releasably engages portions of the limp container peripherally about an opening in the container and supports the container in an open position. A base member formed of a length of flexible light-weight material having the end portions thereof joined together to form a generally circular hoop is also provided. The base member provides stability for the device relative to a surface upon which the device is positioned. A plurality of strut members, each formed of a length of rigid light-weight material, interconnect the rim member and the base member and maintain a desired spaced relationship therebetween. Mounting means secure the rim member and the base member to the plurality of strut members to provide a rigid light-weight support device for the limp containers. Retainer clips which are removably attachable to the rim member secure portions of the limp container which have been folded over the rim member between the container clips and the rim member. Thus, the rigid light-weight support device holds the limp container open and suspended from the rim member such that, as material is inserted into the limp container, the wall portions thereof are tensioned and prevented from collapsing.

According to the present invention, in an alternative exemplary embodiment thereof, the holder may be provided in the form of three base rim tubes, three top rim tubes and three vertical strut tubes, each of such tubes being of normally straight plastic tubing, and six connecting tees, each having studs located in T configuration, whereby the tubes and tees may be conveniently packaged in a rectangular package for shipment before assembly and may be conveniently assembled by press-fitting the tubes and tees together. Strut tube clip means are also provided for clipping the pliant bag to the struts via marginal areas of the bag folded over the top rim to locations adjacent to the vertical strut tubes.

A more complete understanding of the improvements in a device for supporting a limp disposable container in a generally open position in accordance with the present invention, as well as a recognition of additional objects and advantages therefor, will be afforded to those skilled in the art from a consideration of the following detailed description of an exemplary embodiment thereof. Reference will be made to the appended sheet of drawings which will first be discussed briefly.

DETAILED DESCRIPTION OF AN EXEMPLARY EMBODIMENT

Figure 1:
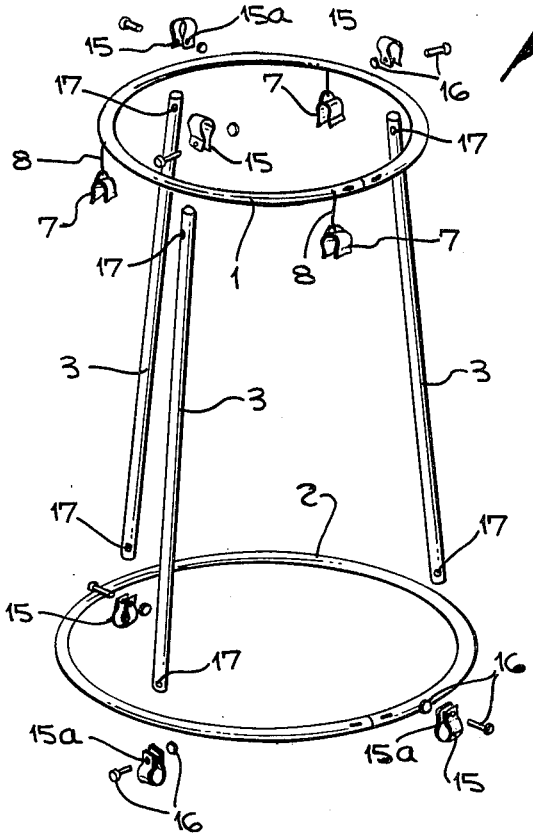
FIG. 1 is an exploded perspective view of the improved device of the present invention showing the relationship between the rim member, base member and strut members.
Figure 2:
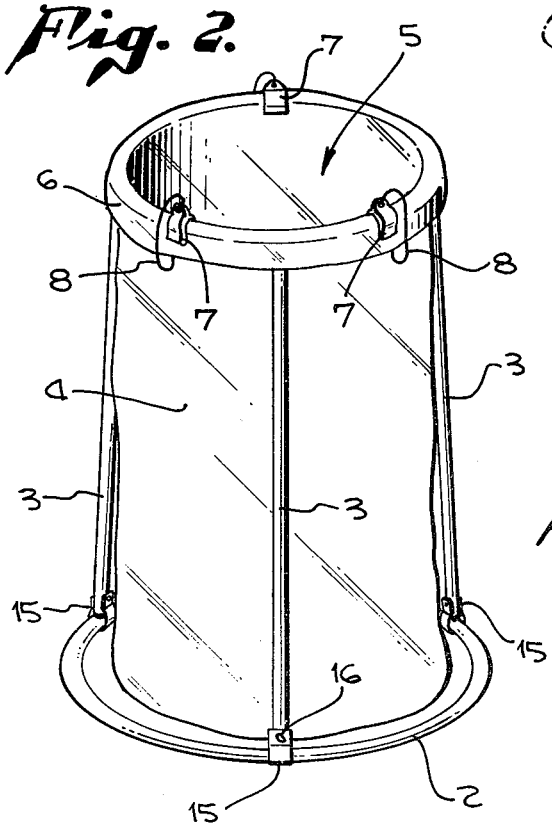
FIG. 2 is a perspective view showing the device of the present invention assembled and with a limp disposable container in place and being supported by the device.

Referring first to FIGS. 1 and 2, a device for supporting a limp disposable container, such as a trash bag, in a generally open position to receive material is shown. As best seen in FIG. 2, the device prevents the container from collapsing as material is inserted therein.

Figure 3:
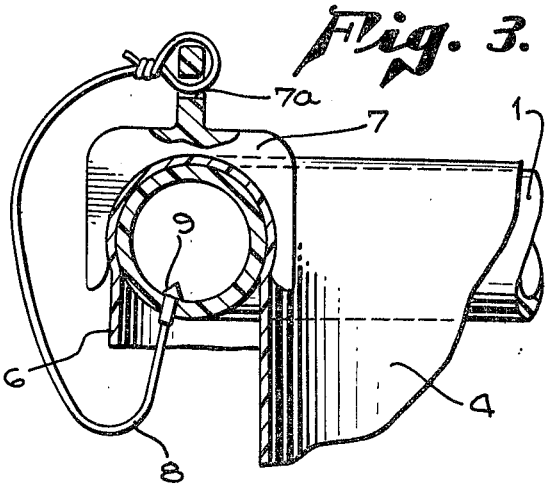
FIG. 3 is a sectional detailed view showing the interrelationship between the rim member, limp container and retainer clip of the present invention.
Figure 4:
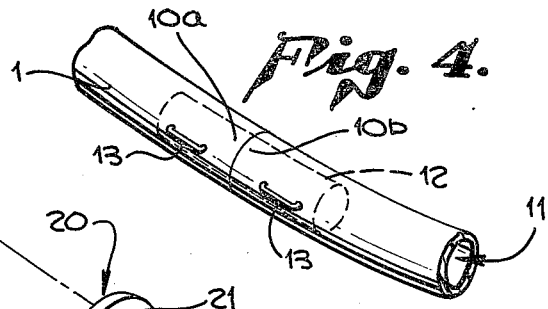
FIG. 4 is a perspective view of a section of a tubular rim member showing a preferred method of joining together of the ends of a length of flexible light-weight tubing.

The device of the instant invention comprises rim means for releasably engaging portions of said container peripherally about an opening in said container and for supporting said portions in an open position. As shown in FIGS. 2 and 3, a rim member 1 formed of a length of flexible light-weight material having the end portions thereof joined together forms a generally circular hoop. As particularly shown in FIG. 4, rim member 1 may comprise a length of flexible hollow tubing turned back on itself, to form a generally circular hoop when ends 10*a* and 10*b* are joined together by means of plug 12 which is inserted partially into internal bore 11 at each of ends 10*a* and 10*b* of the tubing. Plug 12 is secured within internal bore 11 by fastening means such as staples 13.

Rim member 1 releasably engages portions of limp container 4 peripherally about opening 5 in the container and supports the container in an open position. As best seen in FIG. 3, peripheral portion 6 of limp container 4 is folded over rim member 1 and secured thereto by retainer clip 7.

A base member 2 is likewise formed of a length of flexible light-weight material having the end portions thereof joined together to form a generally circular hoop as is shown in FIGS. 1 and 2. Base member 2 provides stability for the device relative to a surface upon which the device is positioned. Additionally, it has been found to be desirable if base member 2 has a relatively greater circumference than rim member 1, as shown in FIGS. 1 and 2, in order to further enhance the stability of the device.

Strut means are provided for interconnecting rim means 1 and base means 2 for maintaining a desired spaced relationship therebetween. As shown in FIGS. 1 and 2, a plurality of strut members 3 each formed of a length of rigid light-weight material interconnect rim member 1 and base member 2 and maintain a desired spaced relationship therebetween. Mounting means secure the rim means and the base means to the strut means to provide a rigid support device for the limp container. In the exemplary embodiment shown in FIG. 1, mounting straps 15 are wrapped about portions of rim member 1 and base member 2. The ends of mounting straps 15 are secured to strut members 3 by any one of several known fastening means, for example nuts and bolts 16 which extend through apertures 15*a* in mounting straps 15 and through apertures 17 in struts 3.

Figure 5:
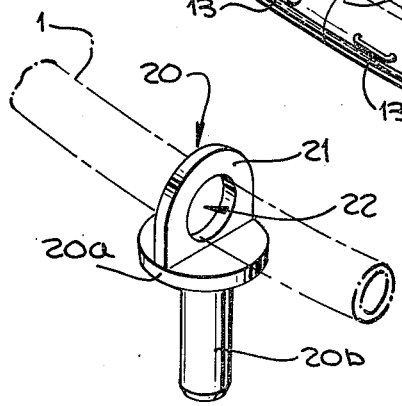
FIG. 5 is a perspective view of a second exemplary embodiment of mounting means for securing the rim member and base member to the strut members.

A second exemplary embodiment in mounting means which is particularly adaptable to tubular strut members is shown in FIG. 5. Mounting member 20 having a mounting flange 20*a* and mounting plug 20*b* is secured to the length of flexible hollow tubing which forms rim member 1 by means of inserting the hollow tubing through aperture 22 in mounting tab 21 prior to turning the tubing back on itself and joining the ends thereof together. To secure the rim member/base member to the strut members, mounting plug 20*b* is inserted into the central bore of a section of rigid hollow tubing which comprises the strut member and flange 20*a* positions the mounting member with respect to the strut member.

Figure 6:
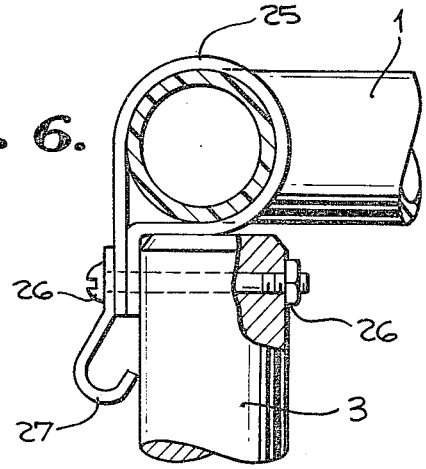
FIG. 6 is a partial sectional view of a third exemplary embodiment of mounting means for securing the rim member or base member to a strut member including the provision of a second embodiment in retainer clips to secure portions of the limp container.

A further exemplary embodiment in mounting means is shown in FIG. 6 wherein mounting strap 25 is wrapped about rim member 1 and the end portions of mounting strap 25 are secured on the same side of strut 3. The mounting strap is, once again, secured to the strut by fastening means such as a nut and bolt 26. Additionally it has been found to be desirable when securing the rim member and the base member to the strut members to space the strut members equi-distant from each other circumferentially about the rim member and the base member as is shown in FIG. 1.

Referring once again to FIGS. 2 and 3, the removable retainer means for securing portions of the limp container to the rim means will be discussed in greater detail. Retainer clips 7 are removably attachable to rim member 1 and secure portions 6 of the limp container 4 which have been folded over rim member 1 between the retainer clips 7 and rim member 1. To prevent retainer clips 7 from becoming lost when removed from rim member 1, means interconnecting the retainer clip and the rim member are provided. As shown in FIG. 3, interconnecting filament 8 is secured to rim member 1 by means of anchor plug 9 is extended through aperture 7*a* in retainer clip 7 and secured therethrough.

Thus, as may be seen in FIG. 2, a rigid light-weight support device is provided which holds the limp container open and suspended from the rim member such that, as material is inserted into the limp container, wall portions thereof are tensioned and prevented from collapsing.

It has been found to be desirable to have rim member 1, base member 2 and strut members 3 fabricated from a light-weight corrosion resistant material such as the various thermoplastic materials which are available from industrial sources.

Additional, it has been found to be desirable if the mounting means selected for securing the rim member and the base member to the strut members comprise releasable elements which allow repeated assembly and disassembly of the device. Thus, when the device is not in use, it may be disassembled and conveniently stored in a small space.

To separate the filled limp container from the instant improved device for supporting said limp container 4, the portions 6 of limp container 4 which have been folded over rim member 1 are released by removing retainer clips 7, opening 5 of the limp container is tied or otherwise sealed and the device of the instant invention is merely lifted from about the filled limp container.

Figure 7:
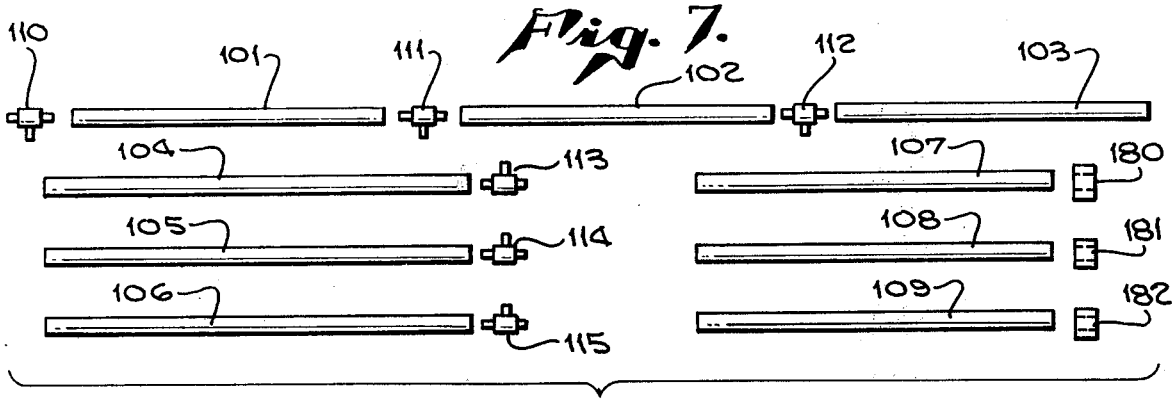
FIG. 7 is an alternative exemplary embodiment of the trash bag holder of the present invention shown in disassembled kit form suitable for shipment and/or sale for assembly by the user.
Figure 8:
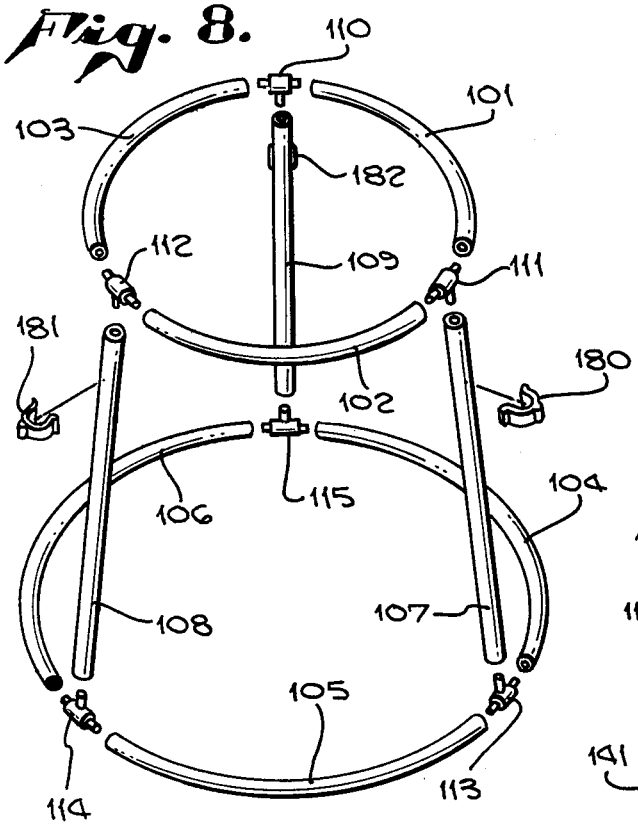
FIG. 8 is an exploded perspective view showing how the various parts of the exemplary trash bag holder of FIG. 7 are positioned for assembly.

Referring now to FIGS. 7 through 11, an alternative exemplary embodiment of the trash bag holder, according to the present invention, is shown which is particularly suitable for shipment and or sale in a "knocked down" or unassembled condition for assembly by the ultimate recipient, such as the buyer or local store salesman. Referring initially to FIG. 8, the top rim means may comprise in this embodiment three top rim tubes 101, 102 and 103 in the form, as seen in FIG. 7, of normally straight plastic tubing. Similarly, the base rim means in this embodiment may comprise three base rim tubes 104, 105 and 106, also as seen in FIG. 7, of normally straight plastic tubing.

The vertical struts means of the alternative exemplary embodiment comprise three vertical strut tubes 107, 108 and 109, as seen in FIGS. 7 and 8, of normally straight plastic tubing. This tubing may be as in the prior exemplary embodiment, a hollow, bendable high impact strength plastic tubing material.

Figure 10:
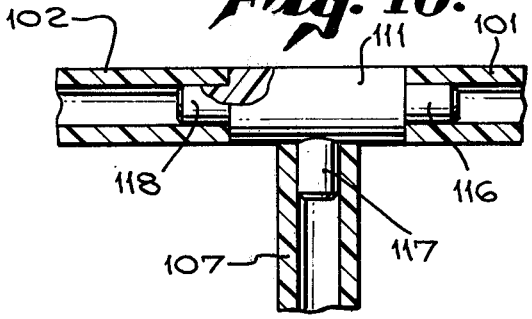
FIG. 10 is a section view of the holder of FIGS. 7 and 8 showing the connection of rim and strut tubes to an interconnecting tee.

According to the method of assembly of the present invention, the three top rim tubes and three bottom rim tubes are bent into the curved configuration of FIG. 8, manually and individually, for assembly to one another by the interconnecting tees 110–115. Each of these tees, as best seen in FIG. 10, is constructed with three studs, or dowel portions, 116, 117 and 118. The studs or dowel portions are located in a T-configuration, as seen in FIG. 10 and are sized to be received within the adjacent tubing bores in a press-fit relation. As is thus apparent from the foregoing, a user or retail sales person can receive the trash bag holder in completely disassembled form and easily press-fit the parts into the assembled relationship as seen in solid line FIG. 9.

Figure 9:
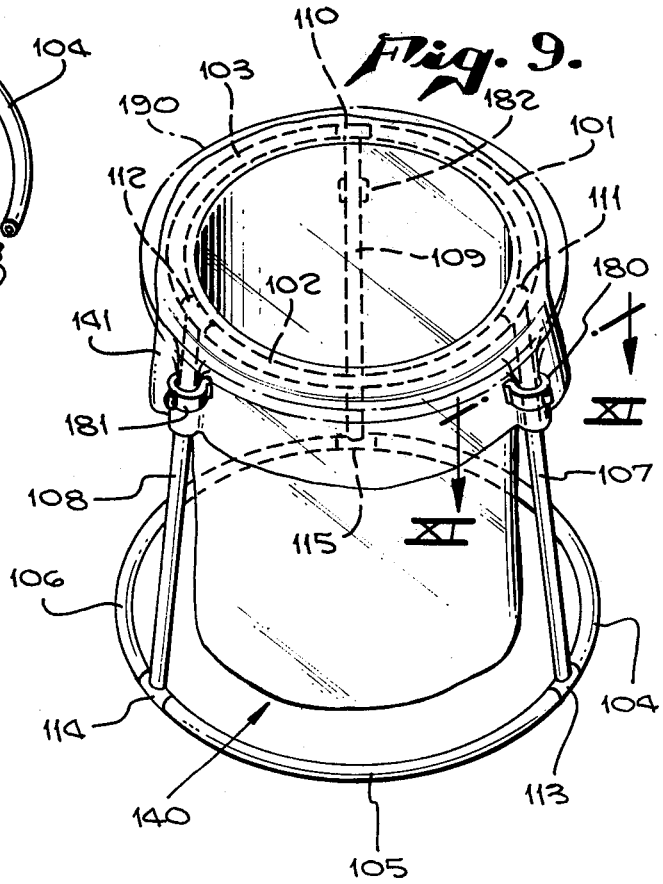
FIG. 9 is a perspective view of the present exemplary trash bag holder in assembled condition with a pliant bag shown in pantom line assembled thereto.
Figure 11:
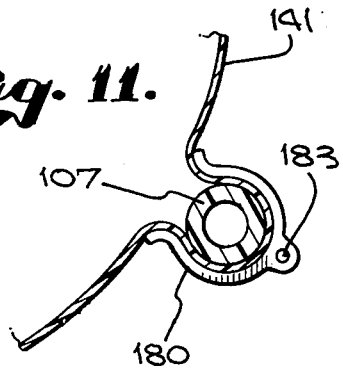
FIG. 11 is a section view of the holder of FIG. 9 taken there and along the plane of XI—XI.

As in the prior embodiment, a trash bag, indicated generally at 140 may be placed within the upper rim means with marginal areas 141 of the bag adjacent its open end being turned down over the rim means and in skirt-like fashion down about the upper portions of the vertical struts 107–109, as seen in FIG. 9. With the bag in this position, and is contemplated within the present invention of this alternative exemplary embodiment, strut tube clip means are provided for fastening these marginal areas of the trash bag to the vertical struts. In the exemplary embodiment, such clip means comprise the provision of three individual plastic, springable clips 180, 181 and 182. As seen in FIG. 11, marginal areas 141 of the bag may be tightly clamped to the vertical struts, as strut 107 by these clips, as clip 180 in FIG. 11. As best seen in FIG. 11, each clip 180–182 may be provided with an aperture, as aperture 183, to receive a wire or rope tie for tying the clip to the top rim or associated vertical strut. An advantage of this alternative embodiment of trash bag holder is that the individual rim members, when provided as three separate tubes, can be packaged for shipment and sale in a container which is approximately the length of the vertical strut members, i.e. equal to the height of the holders when assembled. Also, a cover 190 fits on the top.

Having thus described an exemplary embodiment of an improved device for supporting a limp disposable container in a generally open position to receive material and for preventing the container from collapsing as the material is inserted therein, it should be understood by those skilled in the art that various alternatives and modifications thereof may be made within the scope and spirit of the present invention which is defined by the following claims.

I claim:

1. A trash bag holder for supporting a limp disposable trash bag or the like in a generally open position to receive material and for preventing said container from collapsing as said material is inserted therein, the improvement comprising:

a top rim member comprising three top rim tubes of flexible light-weight normally straight plastic tubing having end portions thereof joined together to form a generally circular closed loop rim for releasably supporting upper marginal portions of said bag peripherally about an opening therein and for supporting said bag in an open position;

a base rim member comprising three base rim tubes of flexible lightweight normally straight plastic tubing having the end portions thereof joined together to form a generally circular closed loop rim, a plurality of vertical strut members comprising three vertical strut tubes, each formed of a length of normally straight rigid light-weight plastic tubing, for supporting said top member spaced above said base rim member and maintain a desired spaced relationship therebetween;

means for releasably and manually securing said rim member, said base member and said plurality of strut members together in press fit interconnections to provide a rigid light-weight support device for said bag, comprising six connecting tees, each having three studs located in tee configuration for fitting into said tubular members;

retainer clips removably attachable to said vertical strut members of said support device for clamping portions of said bag which have been folded over said top rim member between said clips and one of said strut members of said support device whereby said tubes and tees may be conveniently packaged in a non-assembled condition for shipment and thereafter be easily manually assembled and disassembled by press fitting said tubes and tees together and thereafter disassembled by manually pulling said tubes and tees apart; and individual filament means for securing each of said clips to one of said members respectively to facilitate location of the same when not attached to one of said vertical strut members, as when said clips are manually detached during replacing of said bag relative said holder.

* * * * *